US005791006A

United States Patent [19]

Anctil

[11] Patent Number: 5,791,006

[45] Date of Patent: Aug. 11, 1998

[54] CLEANING IMPLEMENT HANDLE SYSTEM

[76] Inventor: Robert Anctil, 2337 W. Waltann La., Phoenix, Ariz. 85023

[21] Appl. No.: 780,588

[22] Filed: Jan. 8, 1997

Related U.S. Application Data

[60] Provisional application No. 60/024,758, Jul. 31, 1996.

[51] Int. Cl. [6] ..... A46B 5/02

[52] U.S. Cl. ..... 15/144.4; 15/143.1; 16/111 R; 16/114 R; D4/132; D32/51

[58] Field of Search ..... 15/143.1, 144.1, 15/144.3, 144.4, 145, 159.1, 171; 16/111 R, 114 R; 81/489; D4/121, 132, 138, 199; D8/10, 11, 13; D32/50, 51

[56] References Cited

U.S. PATENT DOCUMENTS

| | | | |
|---|---|---|---|
| 724,475 | 4/1903 | Hilmo . | |
| 2,051,152 | 8/1936 | Owen . | |
| 2,821,834 | 2/1958 | Walker | D8/13 |
| 3,243,165 | 3/1966 | Woody et al. . | |
| 4,541,139 | 9/1985 | Jones et al. . | |
| 4,642,837 | 2/1987 | Nichols et al. . | |
| 4,673,376 | 6/1987 | Fender . | |
| 4,794,663 | 1/1989 | Vosbikian | 15/144.1 |
| 5,037,235 | 8/1991 | Aquilina . | |
| 5,060,343 | 10/1991 | Nisenbaum | 16/111 R |
| 5,172,447 | 12/1992 | Tomm | 16/114 R |
| 5,623,739 | 4/1997 | Thompson | 15/143.1 |

*Primary Examiner*—Terrence Till
*Attorney, Agent, or Firm*—Joseph N. Breaux

[57] ABSTRACT

A cleaning implement handle system includes a handle member having an implement connecting portion, a shaft portion, and a gripping portion; and an implement connecting fitting assembly having an implement connecting portion including a threaded first end adapted for connection with a conventionally threaded cleaning implement head and a second handle receiving end adapted to receive therein the implement connection portion of the handle member, and a compression ferrule that threadably fits over the second handle receiving end of the implement connecting fitting to compress the second handle receiving end about the implement connection portion of the handle member.

7 Claims, 2 Drawing Sheets

CLEANING IMPLEMENT HANDLE SYSTEM

TECHNICAL FIELD

This application claims the benefits under 35 U.S.C. 119(e) of earlier filed provisional application number 60/024,758, filed Jul. 31, 1996. The present invention relates to cleaning implements and more particularly to a cleaning implement handle system providing a long handle suitable for cleaning a floor surface while in a standing position having a handle configured to ease the strain on the back and hands of the user during use.

BACKGROUND ART

Cleaning a floor or the like is typically accomplished with a long straight handled cleaning implement such as a broom or mop. The long straight handle allows the user to performing the cleaning activities while standing, however, because the handle is straight, the user is required to bend his hands and arms at unnatural and uncomfortable angles to accomplish the cleaning. While the strain caused from these unnatural angles is not debilitating when only a small area is to be cleaned in a single cleaning session, the strain can cause cramping and other undesirable side effects to those individuals tasked with cleaning multiple numbers of such surfaces over an extended period of time. It would be a benefit, therefore, to those individuals to have a handle system for cleaning implements such as brooms and mops that provided a long handle that was configured to allow the implement to be used while maintaining the arms and hands at more natural and less strain inducing angles. It would be a further benefit if the handle system could be adapted for persons of various heights and could be used with a variety of readily available cleaning implement heads.

GENERAL SUMMARY DISCUSSION OF INVENTION

It is thus an object of the invention to provide a cleaning implement handle system that provides a long handle configured to allow the implement to be used while maintaining the arms and hands in more natural less strain inducing angles.

It is a further object of the invention to provide a cleaning implement handle system that is user configurable for use by persons of various heights.

It is a still further object of the invention to provide a cleaning implement handle system that can be used with a variety of readily available cleaning implement heads.

It is a still further object of the invention to provide a cleaning implement handle system that accomplishes all or some of the above objects in combination.

Accordingly, a cleaning implement handle system is provided. The handle system includes a handle member having an implement connecting portion, a shaft portion, and a gripping portion, the shaft portion being substantially straight and having a first and second shaft end, the implement connecting portion being substantially straight and in rigid connection with the first shaft end at an angle "A" of between twenty and thirty-five degrees, the gripping portion having an arcuate portion having a first arcuate end in rigid connection with the second shaft end and a second arcuate end in rigid connection with a substantially straight handle end portion, the arcuate portion being disposed along an arcuate path defined by a radius sweeping an angle "B" of between one-hundred-twenty and one-hundred-eighty degrees and lying in a plane defined by the implement connecting portion and the shaft portion; and an implement connecting fitting assembly having an implement connecting portion including a threaded first end adapted for connection with a conventionally threaded cleaning implement head and a second handle receiving end adapted to receive therein the implement connection portion of the handle member, and a compression ferrule that threadably fits over the second handle receiving end of the implement connecting fitting to compress the second handle receiving end about the implement connection portion of the handle member.

The handle member can have an adjustable length shaft portion if desired by the use of a conventional telescoping construction. The threaded first end of the implement connecting portion is preferably provided with acme type threads.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
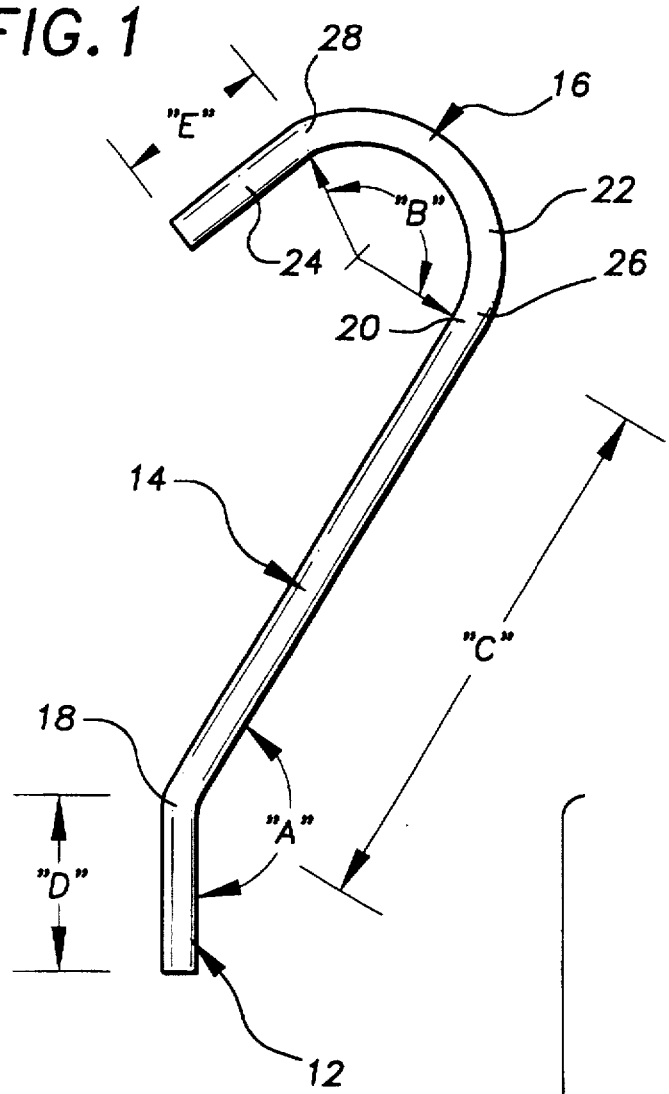
FIG. 1 is a side view of an exemplary embodiment of the handle member of the cleaning implement handle system showing the implement connecting portion, the shaft portion, and the gripping portion.

FIG. 1 shows an exemplary handle member of the handle system of the present invention generally designated by the numeral 10. In this embodiment, handle member 10 is formed from a single five foot length of three-quarter inch (¾") conduit. Handle member 10 includes an implement connecting portion, generally designated by the numeral 12; a shaft portion, generally designated by the numeral 14; and a gripping portion, generally designated by the numeral 16. Shaft portion 14 is substantially straight, of a length "C" of forty (40") inches, and has a first shaft end 18 and a second shaft end 20. Implement connecting portion 12 is substantially straight, of a length "D" of four and three-quarters (4¾") inches and bent with respect to shaft portion 14 at an angle "A" of twenty-seven degrees.

Gripping portion 16 includes an arcuate portion 22 and a handle end portion 24. Arcuate portion 22 is twelve (12")

inches in length and has a first arcuate end 26 in rigid connection with second shaft end 20 and a second arcuate end 28 in rigid connection with handle end portion 24. In this embodiment arcuate portion is disposed along an arcuate path defined by a radius sweeping an angle "B" of one-hundred-forty (140°) degrees and lying in the plane defined by implement connecting portion 12 and shaft portion 14. Handle end portion 24 is straight and is of a length "E" of about three and one-quarter (3¼") inches.

Figure 2:
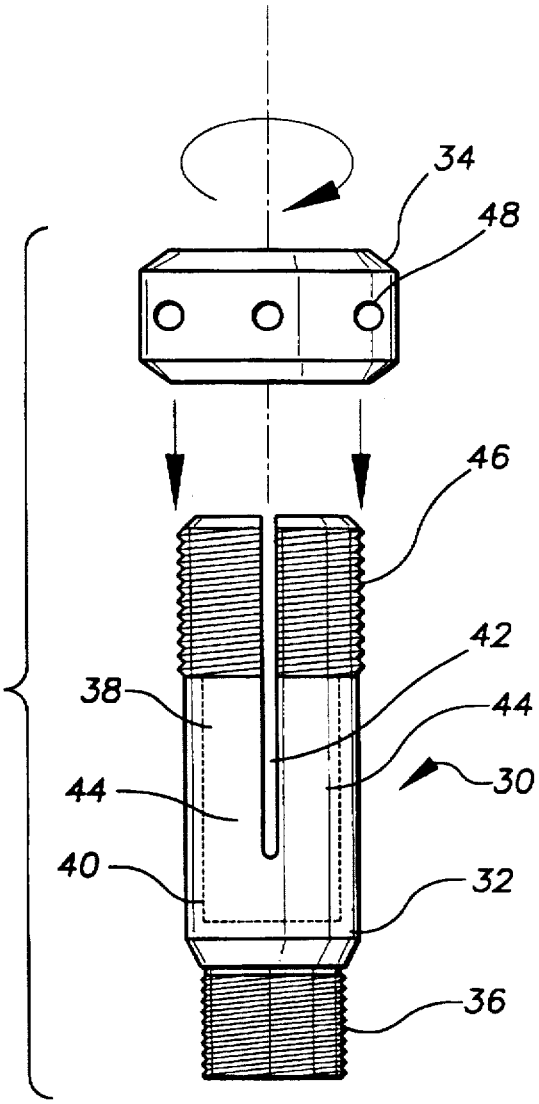
FIG. 2 is a plan view of an exemplary implement connecting fitting of the cleaning implement handle system of the present invention showing the implement insertion portion having a threaded first end adapted for connection with a cleaning implement head and the compression ferrule that threadably fits over a second handle receiving end of the implement insertion portion to compress the implement receiving end about the implement connection portion of the handle member.

FIG. 2 shows an exemplary implement connecting fitting assembly generally designated by the numeral 30. Fitting assembly 30 is of molded plastic construction and includes an implement connecting portion 32 and a ring shaped, internally threaded compression ferrule 34. Implement connecting portion 32 has a threaded first end 36 that threaded with conventional acme threads to threadably mate with a conventionally threaded cleaning implement head (shown in FIGS. 3–5), and a second handle receiving end 38 having a cavity 40 sized to receive therein implement connection portion 12 of handle member 10. Four compression slots 42 (only one shown) are formed along the length thereof to allow the side sections 44 to be compressed against implement connection portion 12 when threaded compression ferrule 34 is threaded onto threads 46 and tightened. In this embodiment, compression ferrule 34 is provided with a number of tightening apertures 48 into which a tightening tool such a rigid metal rod can be inserted to assist the user in tightening compression ferrule 34.

Figure 3:
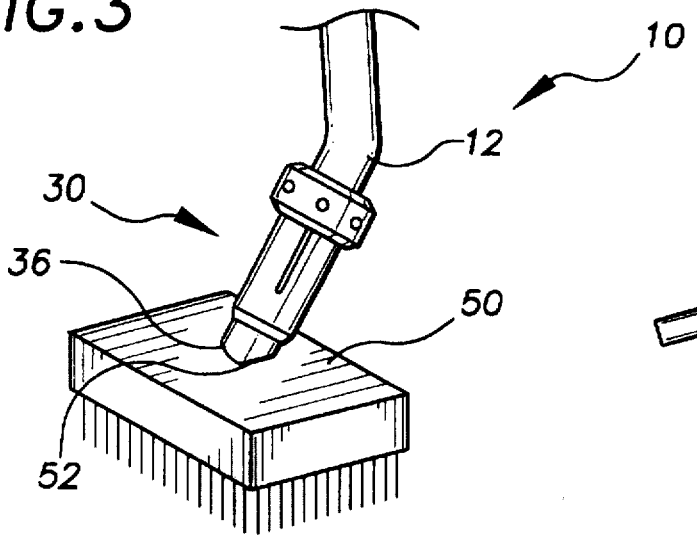
FIG. 3 is a perspective view of the implement connecting fitting of FIG. 2 in connection between a representative cleaning implement head and the implement connection portion of the handle member of FIG. 1.

FIG. 3 shows implement connection fitting assembly 30 in connection between a representative cleaning implement head 50 and implement connection portion 12 of handle member 10. Cleaning implement head 50 is provided with a conventional internally threaded bore 52 into which first end 36 is threadably secured.

Figure 4:
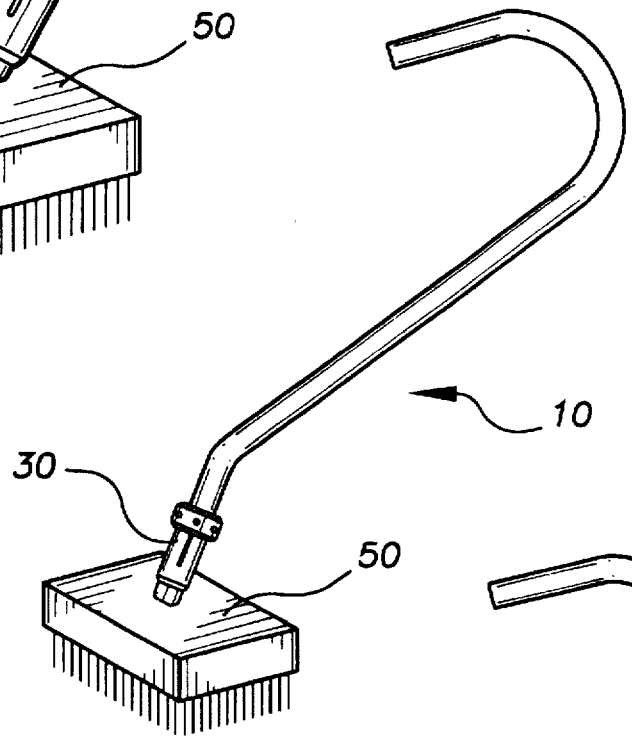
FIG. 4 is a perspective view of the exemplary handle member, connection fitting and representative cleaning head as configured during use.
Figure 5:
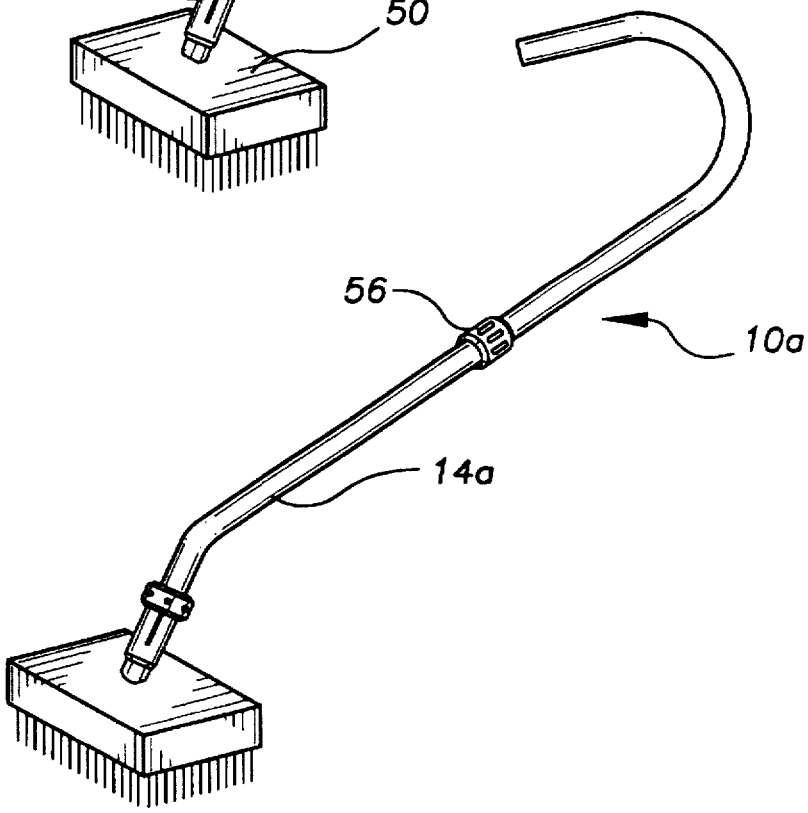
FIG. 5 is a perspective view showing a second exemplary handle member having a telescoping construction and a compression fitting to allow the user to adjust the handle member to a desired length.

FIG. 4 shows handle member 10 and implement connection fitting assembly 30 in connection with representative cleaning implement head 50. FIG. 5 shows a second exemplary handle member **10*a* including a telescoping shaft portion 14*a* having a conventional compression fitting 56 to allow the user to set the length of shaft portion 14** to a desired length.

It can be seen from the preceding description that a cleaning implement handle system has been provides that has a long handle configured to allow the implement to be used while maintaining the arms and hands in more natural less strain inducing angles; that is user configurable for use by persons of various heights; and that can be used with a variety of readily available cleaning implement heads.

It is noted that the embodiment of the cleaning implement handle system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A cleaning implement handle system comprising:

a handle member having an implement connecting portion, a shaft portion, and a gripping portion, said shaft portion being substantially straight and having a first and second shaft end, said implement connecting portion being substantially straight and in rigid connection with said first shaft end at an angle of between twenty and thirty-five degrees, said gripping portion having an arcuate portion having a first arcuate end in rigid connection with said second shaft end and a second arcuate end in rigid connection with a substantially straight handle end portion, said arcuate portion being disposed along an arcuate path defined by a radius sweeping an angle of between one-hundred-twenty and one-hundred-eighty degrees and lying in a plane defined by said implement connecting portion and said shaft portion; and an implement connecting fitting assembly having an implement connecting portion including a threaded first end adapted for connection with a conventionally threaded cleaning implement head and a second handle receiving end adapted to receive therein said implement connection portion of said handle member, and a compression ferrule that threadably fits over said second handle receiving end of said implement connecting fitting to compress said second handle receiving end about said implement connection portion of said handle member.

2. The cleaning implement handle system of claim 1, wherein:

said handle member has an adjustable length shaft portion.

3. The cleaning implement handle system of claim 2, wherein:

said adjustable length shaft portion is of telescoping construction.

4. The cleaning implement handle system of claim 1, wherein:

said handle member is formed from a single length of conduit.

5. The cleaning implement handle system of claim 1, wherein:

said shaft portion is substantially straight; and said implement connecting portion is substantially straight and bent with respect to said shaft portion at an angle of twenty-seven degrees.

6. The cleaning implement handle system of claim 5, wherein:

said arcuate portion is twelve inches in length and is disposed along an arcuate path defined by a radius sweeping an angle of one-hundred-forty degrees.

7. The cleaning implement handle system of claim 1, wherein:

said arcuate portion is twelve inches in length and is disposed along an arcuate path defined by a radius sweeping an angle of one-hundred-forty degrees.

* * * * *